US006742514B1

(12) United States Patent
Eastman, II

(10) Patent No.: US 6,742,514 B1
(45) Date of Patent: Jun. 1, 2004

(54) BURNER ASSEMBLY, OUTDOOR STOVE INCLUDING SAME, AND STOVE KIT

(75) Inventor: Robert Eastman, II, Flint, MI (US)

(73) Assignee: Eastman Outdoors, Flushing, MI (US)

( * ) Notice: Subject to any disclaimer, the term of this patent is extended or adjusted under 35 U.S.C. 154(b) by 0 days.

(21) Appl. No.: 10/165,607

(22) Filed: Jun. 7, 2002

(51) Int. Cl.[7] ..... F24C 5/20; F23D 14/02

(52) U.S. Cl. ..... 126/38; 126/39 R; 431/284; 239/559

(58) Field of Search ..... 126/39 R, 38; 431/284; 239/559

(56) References Cited

U.S. PATENT DOCUMENTS 2,486,278 A * 10/1949 Harper ..... 239/559
2,544,603 A * 3/1951 Lamar et al. ..... 239/559
2,825,325 A 3/1958 Ross
4,726,350 A 2/1988 Steinhauser
4,759,339 A 7/1988 Hefling
5,152,276 A * 10/1992 Brock et al. ..... 126/39 R
5,639,232 A 6/1997 Bogenschutz et al.
5,979,428 A * 11/1999 Greene, Jr. ..... 126/38
5,979,431 A 11/1999 Hamilton et al.
6,131,561 A 10/2000 Maxwell et al.
6,322,354 B1 * 11/2001 Carbone et al. ..... 431/284

* cited by examiner

*Primary Examiner*—Sara Clarke
(74) *Attorney, Agent, or Firm*—Carrier, Blackman & Associates, P.C.; William D. Blackman; Joseph P. Carrier

(57) ABSTRACT

A burner apparatus for an outdoor cooking stove includes a hollow gas distribution ring, and an attached fuel conduit for sending fuel thereto. The gas ring has a hollow plenum formed therein. In a specific embodiment, the gas ring includes a base portion and an annular cap which is attachable to the base portion, and the annular cap has a plurality of primary apertures formed therethrough, as well as a plurality of secondary apertures which are smaller than the primary apertures. The secondary apertures are located at a level below the primary apertures. The fuel conduit has a hollow passage formed therethrough, which is in fluid communication with the plenum of the gas distribution ring. An outdoor cooking stove including the burner apparatus is also described, along with a kit for constructing same.

17 Claims, 4 Drawing Sheets

BURNER ASSEMBLY, OUTDOOR STOVE INCLUDING SAME, AND STOVE KIT

BACKGROUND OF THE INVENTION

1. Field of the Invention

The present invention relates to burner assembly for an outdoor cooking stove, to an outdoor cooking stove incorporating the inventive burner assembly, and to a kit for building the outdoor stove. More particularly, the present invention relates to a burner assembly in which a burner element includes a hollow gas distribution ring having a first set of apertures formed therein at a first level and a second set of apertures formed therein at a second level; to an outdoor stove including the described burner, and to a kit for building the stove.

2. Description of the Background Art

A number of different designs are known for outdoor cooking stoves, and burners intended for use with outdoor stoves. Examples of some of the known outdoor cooking stoves include U.S. Pat. Nos. 2,825,325, 4,726,350, 4,759,339, 5,979,431, and 6,131,561. A gas burner which includes a removable drip cover is described in U.S. Pat. No. 5,639,232.

Although the known stoves and burners have some utility for their intended purposes, a need still exists in the art for an outdoor cooking stove which is superior to the currently available models. In particular, there is a need for an improved outdoor cooking stove and burner which is relatively clean-burning and which efficiently uses a compressed gas fuel.

SUMMARY OF THE INVENTION

The present invention provides a burner assembly for an outdoor cooking stove, to a cooking stove incorporating the burner, and to a kit for building the stove. A burner according to a particular embodiment of the present invention uses a gas distribution ring with a first set of primary apertures, supplemented by a set of secondary apertures which are smaller than the primary apertures, and which are located therebelow. Optionally, the gas ring may include additional sets of primary and secondary apertures.

A burner apparatus in accordance with the present invention includes a hollow gas distribution ring, and an attached fuel conduit for routing pressurized fuel to the gas ring. Preferably, the gas distribution ring has a central opening formed substantially vertically therethrough, which does not communicate with the interior of the ring.

The gas ring has a hollow plenum formed therein. In a specific embodiment, the gas ring includes a base portion and an annular cap which is attachable to the base portion. The annular cap has a plurality of primary apertures formed therethrough in a defined pattern, as well as a plurality of secondary apertures which are smaller than the primary apertures. The secondary apertures are located at a level below the primary apertures.

The fuel conduit has a hollow passage formed therethrough, which is in fluid communication with the plenum of the gas distribution ring.

Accordingly, it is an object of the present invention to provide an improved outdoor cooking stove and burner therefor.

It is another object of the present invention to provide a kit of components which may be assembled to construct the stove hereof.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Figure 1:
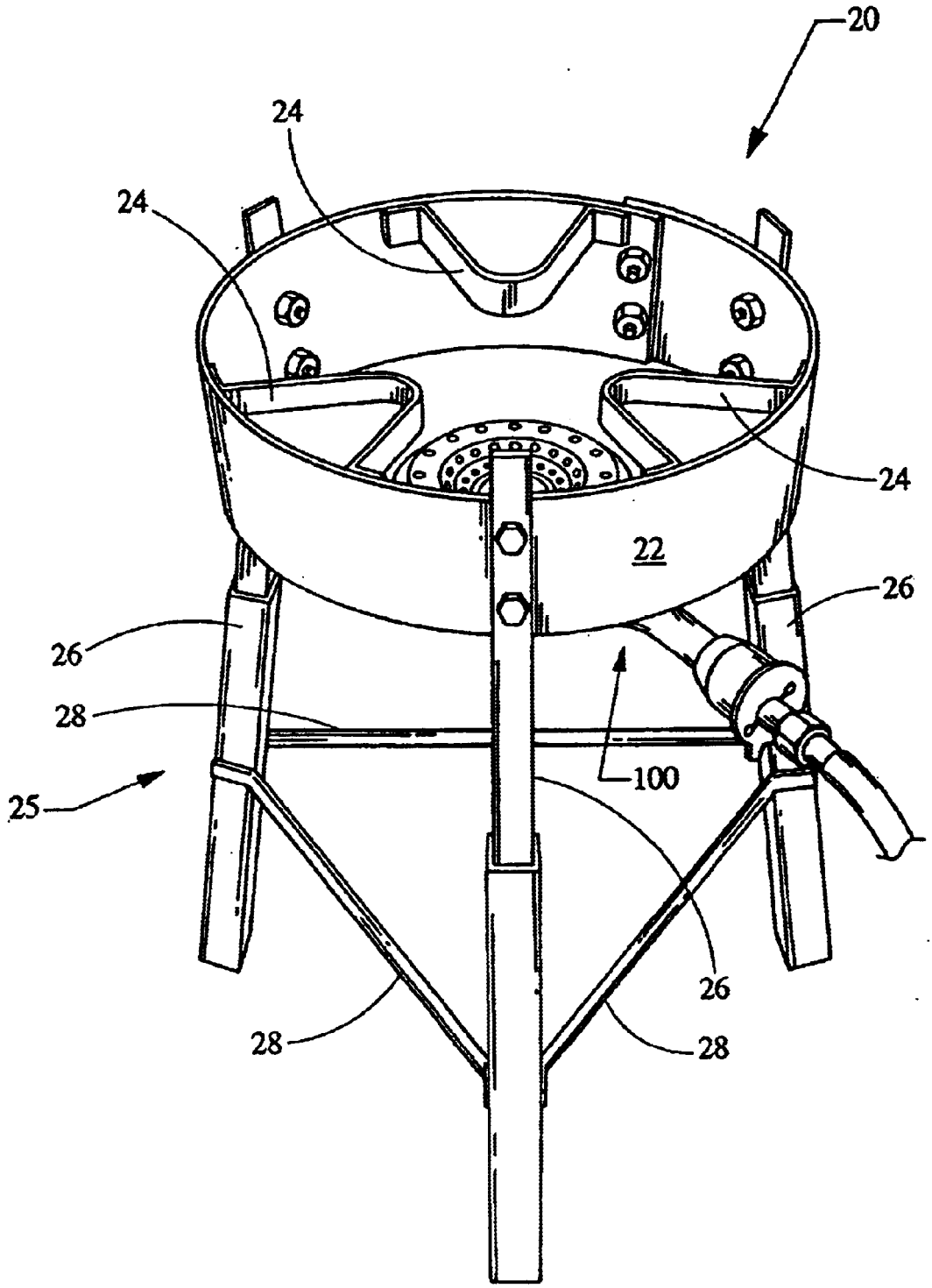
FIG. 1 is a perspective view of an outdoor stove apparatus in accordance with a first embodiment of the invention, the stove including an improved burner assembly.
Figure 2:
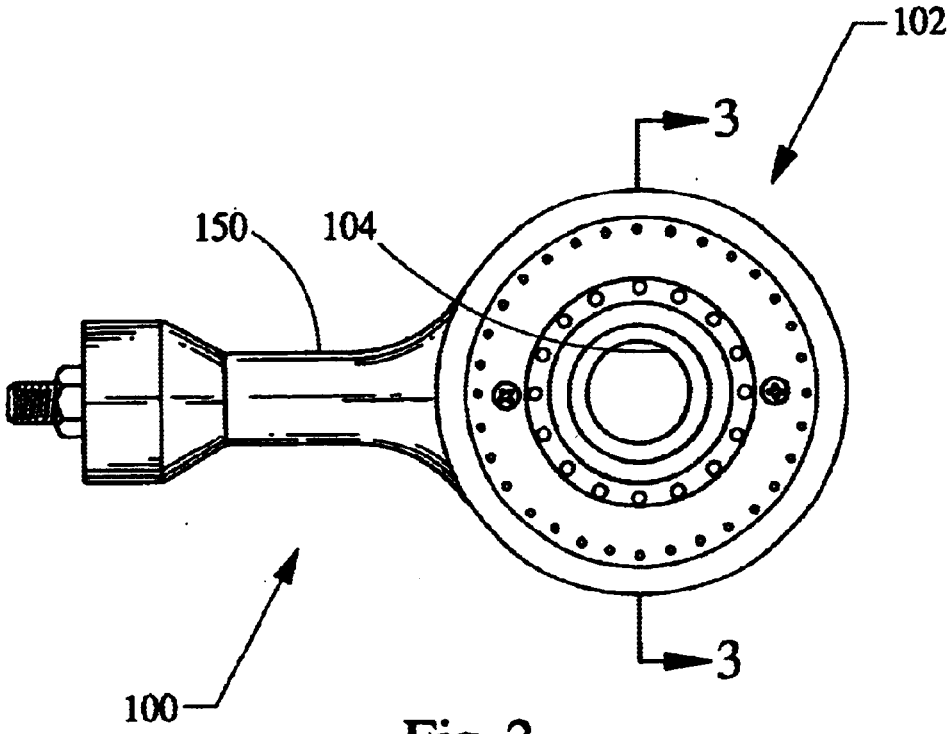
FIG. 2 is a top plan view of a burner assembly which is a component of the stove apparatus of FIG. 1.

Referring now to the drawings, an outdoor cooking stove in accordance with a first embodiment of the present invention is shown generally at 20 in FIG. 1. The stove 20 is designed and intended to bum compressed gaseous fuel, such as propane or the like. The stove 20 incorporates a unique burner assembly 100, which will be described in detail below.

The stove 20 also includes a windscreen 22 for shielding the burner 100, and a support frame 25 for spacing the burner 100 and windscreen 22 upwardly away from a supportive substrate such as the ground. In the depicted embodiment, the windscreen 22 is substantially cylindrical in shape.

In the embodiment shown in FIG. 1, the support frame 25 includes three upstanding legs 26 and three cross-braces 28. Bach of the legs 26 is attached to the windscreen 22 using conventional fasteners, such as by welding or by using nuts and bolts. Similarly, the cross-braces 28 are attached to the legs 26 using conventional fasteners.

Figure 5:
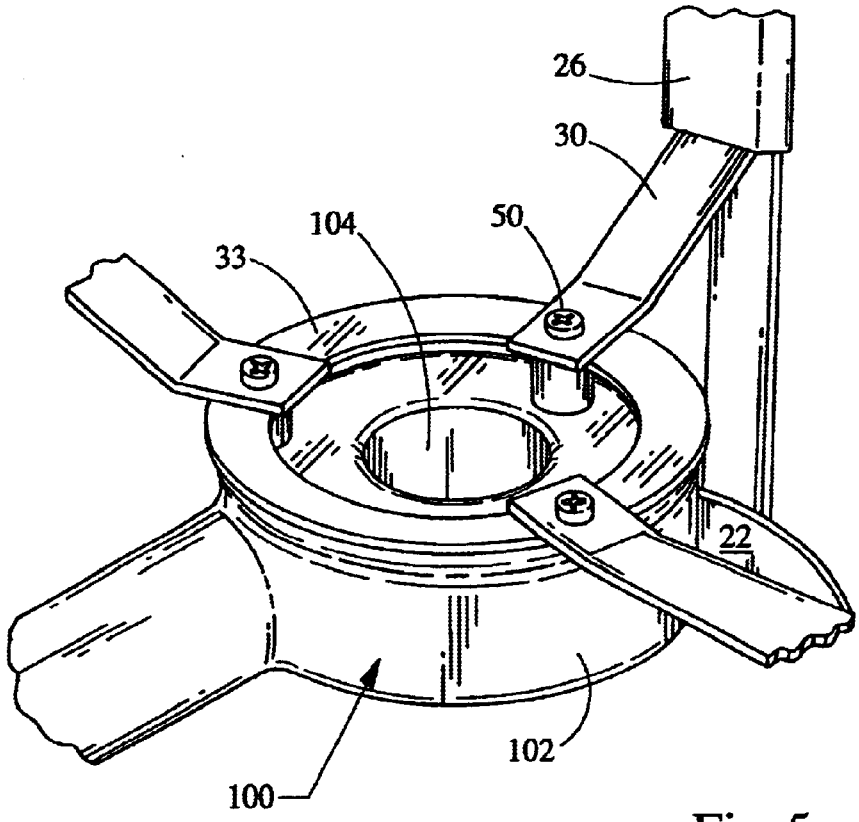
FIG. 5 is an inverted detail perspective view of the burner assembly and stove of FIG. 1.
Figure 6:
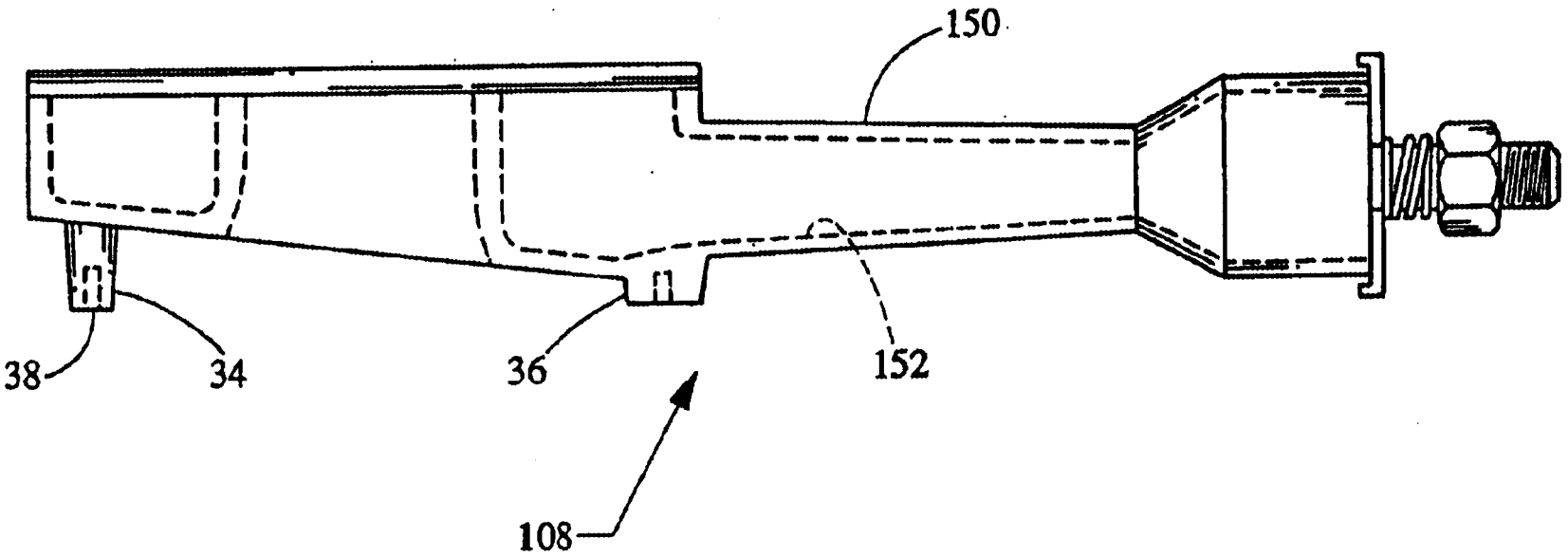
FIG. 6 a side plan view of a base member which is a component of the burner assembly of FIGS. 2–3.

As seen best in FIG. 5, each of the legs 26 may include a reinforcing strut 30, extending radially inwardly in the windscreen 22, for attachment to the underside of the burner assembly 100 using conventional fasteners 50 such as screws, bolts, or similar hardware. A hollow support plate 33 may also be provided for placement between the burner assembly 100 and the reinforcing struts 30, as shown.

Also as seen in the drawing, the stove 20 includes three vessel support members 24 attached to an inner surface of the windscreen 22. The vessel support members 24 are substantially horizontally oriented, and cooperate to define a grid for supporting a cooking vessel thereon, such as a pot or pan.

Referring now to FIGS. 2–6, a burner apparatus 100 in accordance with the present invention includes a hollow gas distribution ring 102, and a fuel conduit 150 attached to the gas ring, for routing pressurized fuel thereto. (The gas distribution ring 102 may also be referred to herein as the gas ring 102). Preferably, the gas ring 102 has a central opening 104 formed substantially vertically therethrough, which does not communicate with the interior of the ring.

Figure 3:
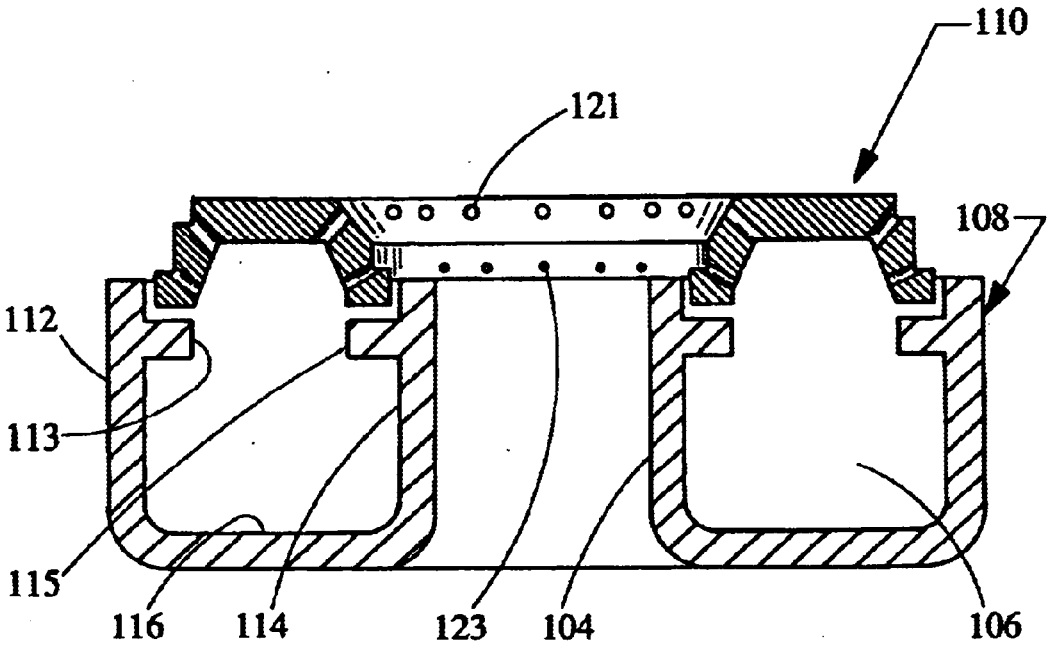
FIG. 3 is a cross-sectional view of a gas distribution ring of the burner assembly of FIG. 2, taken along the line 3—3 thereof.
Figure 4:
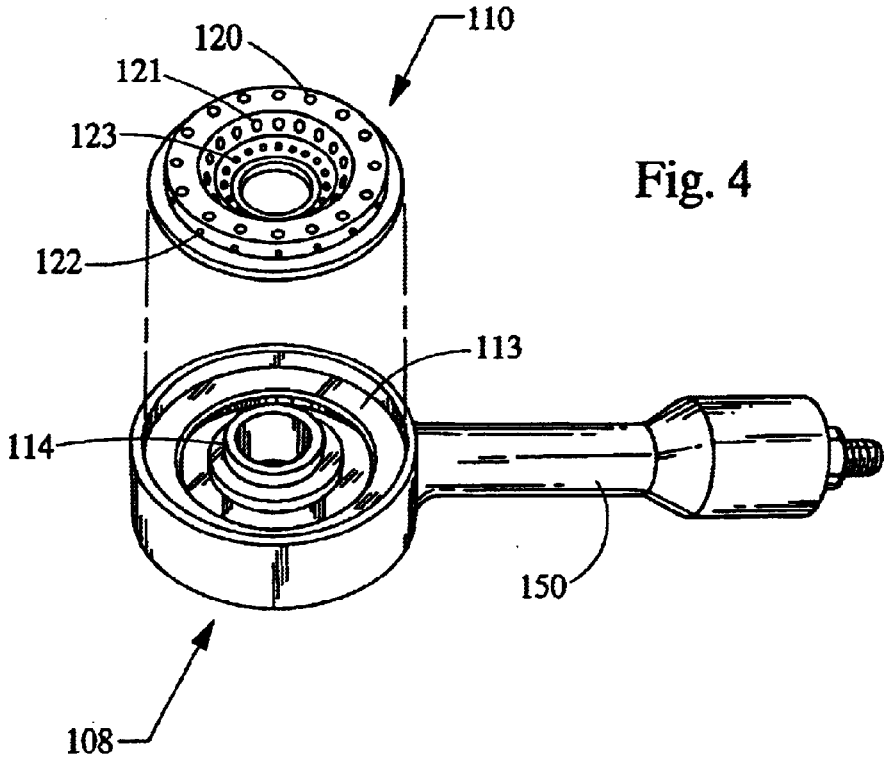
FIG. 4 is an exploded perspective view of the burner assembly of FIGS. 2–3.

As seen in FIG. 3 and 4, the gas distribution ring 102 has an upper portion with a plurality of primary apertures 120 formed therethrough, and defining a first set of apertures arranged in a first pattern around the outer periphery of the ring. The primary apertures have a first diameter. The primary apertures are preferred to be between 2–3.5 mm in diameter, more preferably 2.2–3 mm, and most preferably 2.4–2.8 mm. In a specific embodiment of the invention, the primary apertures are 2.6 mm, plus or minus 0.1 mm.

The gas distribution ring further has a plurality of secondary apertures 122 formed therethrough, the secondary apertures 122 having a second diameter which is smaller than the first diameter. The secondary apertures 122 are preferred to be between 0.5–2 mm in diameter, more preferably 0.6–1.8 mm, and most preferably 0.8–1.8 mm. In a specific embodiment of the invention, the secondary apertures are 1.4 mm, plus or minus 0.015 mm.

The secondary apertures 122 form a second set of apertures arranged in a second pattern surrounding the outer periphery of the gas ring 102. The second pattern is located on the gas ring 102 at a level below the first pattern, as shown.

The gas ring 102 has a hollow plenum 106 formed therein. In the embodiment of FIGS. 2–5,the gas ring 102 includes a base portion 108 and an annular cap 110, which is attachable to the base portion.

The base portion 108 includes an outer side wall 112, an inner side wall 114 and a floor 116 interconnecting the side walls 112, 114. Each of the respective side walls 112, 114 of the base portion has a narrow shelf 113, 115 extending inwardly therefrom to support the annular cap 110. The base portion 108 is preferred to have a plurality of feet, such as that shown at 34, 36 in FIG. 5, extending downwardly on the bottom thereof. Each of the feet 34, 36 has a hollow bore 38 formed centrally therein to receive a fastener 50. The bore 38 is preferred to have female threads formed therein.

The annular cap 110 has a plurality of primary apertures formed therethrough, as well as a plurality of secondary apertures 122, which are smaller than the primary aperture. The secondary apertures 122 are located at a level below the primary apertures 120.

The fuel conduit 150 has a hollow passage 152 formed therethrough, which is in fluid communication with the plenum 106 of the gas distribution ring.

Without wishing to be bound by any theory, it is believed that the pressurized gaseous fuel is at a certain pressure in the fuel conduit 150, and that there is a first pressure drop as the fuel passes the secondary apertures 122, with some of the fuel passing outwardly therethrough and becoming burned. Subsequently, a reduced pressure is seen at the primary apertures 120, located at a higher level on the burner 100.

Therefore, it is believed that it is advantageous to have these higher (primary) apertures 120 larger in size, so that the net volume of the combustible gas flowing outwardly from the respective primary and secondary apertures is comparable.

In the depicted embodiment, the upper portion of the gas distribution ring 102 has a further plurality of primary apertures 121 formed therethrough and defining a third set of apertures forming a third pattern surrounding the central opening. The third pattern is located substantially coaxially inside the first pattern.

Also in the depicted embodiment, the gas distribution ring 102 also has a further plurality of secondary apertures 123 formed therethrough and defining a fourth set of apertures. This fourth set of apertures 123 forms a fourth pattern surrounding the central opening 104 at a level below the third pattern. The fourth pattern is located coaxially inside the second pattern. Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A burner apparatus for an outdoor cooking stove, said burner apparatus comprising:

a gas distribution ring having a hollow plenum formed therein, said gas distribution ring having a central opening formed substantially vertically therethrough which does not communicate with said plenum:

said gas distribution ring having an upper portion with a plurality of primary apertures formed therethrough and defining a first set of apertures arranged in a first pattern around an outside surface of said ring, said primary apertures having a first diameter;

said gas distribution ring further having a plurality of secondary apertures formed therethrough, said secondary apertures having a second diameter which is smaller than the first diameter;

wherein the secondary apertures form a second set of apertures arranged in a second pattern around the outside surface of said ring, said second pattern located at a level below the first pattern; and a fuel conduit attached to the gas distribution ring and in fluid communication therewith, said fuel conduit having a hollow passage formed therethrough which is in fluid communication with the plenum of the gas distribution ring.

2. The burner apparatus of claim 1, wherein the gas distribution ring comprises a base portion having an inner side wall, an outer side wall and a floor interconnecting the side walls; and an annular cap which is attachable to the top of the base portion;

wherein said primary and secondary apertures are located in said annular cap.

3. The burner apparatus of claim 2, wherein the annular cap has an inner side wall, an inside flange extending substantially horizontally inwardly from said inner side wall, an outside wall, an outside flange extending substantially horizontally outwardly from said outer side wall, and a web portion interconnecting the upper ends of said inner and outer side walls;

said outside flange meeting said outer side wall to form a junction therebetween, and wherein each of said secondary apertures comprises an outlet located proximate the junction between said outer side wall and said outside flange.

4. The burner apparatus of claim 1, wherein the upper portion of said gas distribution ring has a further plurality of primary apertures formed therethrough and defining a third set of apertures forming a third pattern surrounding said central opening;

said gas distribution ring also having a further plurality of secondary apertures formed therethrough and defining a fourth set of apertures forming a fourth pattern located at a level below said third pattern.

5. A kit for constructing a cooking stove apparatus, comprising:

a wind screen;

a support structure operatively attachable to the wind screen for spacing it upwardly away from a substrate;

a grid for supporting a cooking vessel, said grid being operatively attachable to the wind screen; and a burner apparatus for attachment to said support apparatus, wherein said burner apparatus is the apparatus of claim 1.

6. A burner apparatus for an outdoor cooking stove, said burner apparatus comprising:

a gas distribution ring having a hollow plenum formed therein, said gas distribution ring having a central opening formed substantially vertically therethrough which does not communicate with said plenum;

said gas distribution ring comprising a base portion having an inner side wall, an outer side wall and a floor; and said gas distribution ring further comprising an annular cap which is attachable to the base portion; said annular cap having an outer surface with a first set of primary apertures formed therethrough, said primary apertures having a first diameter;

said outer surface of said annular cap further having a plurality of secondary apertures formed therethrough, said secondary apertures having a second diameter which is less than the first diameter;

wherein the secondary apertures are located at a level below the primary apertures; and a fuel conduit attached to the gas distribution ring and in fluid communication therewith, said fuel conduit having a hollow passage formed therethrough which is in fluid communication with the plenum of the gas distribution ring.

7. The burner apparatus of claim 6, further comprising an adjustable air vent on the fuel conduit.

8. The burner apparatus of claim 6, wherein the annular cap has an inner side wall, an inside flange extending substantially horizontally inwardly from said inner side wall, an outside wall, an outside flange extending substantially horizontally outwardly from said outer side wall, and a web portion interconnecting the upper ends of said inner and outer side walls;

said outside flange meeting said outer side wall to form a junction therebetween, and wherein each of said secondary apertures comprises an outlet located proximate the junction between said outer side wall and said outside flange.

9. The burner apparatus of claim 6, wherein the annular cap of said gas distribution ring has an inner side wall with a plurality of inner primary apertures formed therethrough, said inner primary aperture having a diameter which is substantially similar to the first diameter;

said annular cap further having a plurality of inner secondary apertures formed therethrough, said inner secondary apertures having a diameter which is less than the diameter of the inner primary apertures;

wherein the secondary apertures in the inner side wall of said annular cap are located at a level below the inner primary apertures.

10. A burner apparatus for an outdoor cooking stove, said burner apparatus comprising:

a gas distribution ring having a hollow plenum formed therein and having a central opening formed substantially vertically therethrough which does not communicate with said plenum;

said gas distribution ring having an upper portion with a first plurality of primary apertures formed therethrough and defining a first set of apertures arranged in a first pattern around an outer surface of said ring, said primary apertures having a first diameter;

said gas distribution ring further having a plurality of secondary apertures formed therethrough, said secondary apertures having a second diameter which is smaller than the first diameter;

wherein the secondary apertures form a second set of apertures arranged in a second pattern around the outer surface of said ring and located at a level below the first pattern;

said gas distribution ring having further plurality of primary apertures formed therethrough and defining a third set of apertures forming a third pattern surrounding said central opening;

said gas distribution ring also having a further plurality of secondary apertures formed therethrough and defining a fourth set of apertures forming a fourth pattern around the interior surface of said ring and located at a level below said third pattern; and a fuel conduit attached to the gas distribution ring and in fluid communication therewith, said fuel conduit having a hollow passage formed therethrough which is in fluid communication with the plenum of the gas distribution ring.

11. The burner apparatus of claim 10, wherein the gas distribution ring comprises a base portion having an inner side wall, an outer side wall and a floor interconnecting the side walls; and an annular cap which is attachable to the top of the base portion;

wherein said primary and secondary apertures are located in said annular cap.

12. The burner apparatus of claim 11, wherein the annular cap has an inner side wall, an inside flange extending substantially horizontally inwardly from said inner side wall, and outer side wall, and outside flange extending substantially horizontally outwardly from said outer side wall, and a web portion interconnecting the upper ends of said inner and outer side walls;

said outside flange meeting said outer side wall to form a junction therebetween, and wherein each of said secondary apertures comprises an outlet located proximate the junction between said outer side wall and said outside flange.

13. The burner apparatus of claim 11, wherein the base portion of the gas distribution ring has a narrow shelf extending inwardly from each of the respective side walls thereof, for support the annular cap therein.

14. A burner apparatus for an outdoor cooking stove, said burner apparatus comprising:

a gas distribution ring having a hollow plenum formed therein and having a central opening formed substantially vertically therethrough which does not communicate with said plenum, said gas distribution ring comprising a base portion having an inner side wall, an outer side wall and a floor; and said gas distribution ring further comprising an annular cap which is attachable to the base portion; said annular cap comprising an inner side wall, an inside flange extending substantially horizontally inwardly from said inner side wall, an outer side wall, an outside flange extending substantially horizontally outwardly from said outer side wall, and a web portion interconnecting the upper ends of said inner and outer side walls;

said outside flange meeting said outer side wall to form a junction therebetween, wherein said annular cap has a first set of primary apertures formed therethrough, said first set of primary apertures having a first diameter and being arranged in a pattern around an outer surface of said annular cap;

said annular cap further having a plurality of secondary apertures formed therethrough, said secondary apertures having a second diameter which is less than the first diameter, wherein the secondary apertures form a second set of apertures arranged in a second pattern around the outer surface of said annular cap and located at a level below the first pattern, each said secondary apertures of said second pattern comprising an outlet located proximate the junction between said outer side wall and said outside flange;

said annular cap having a further plurality of primary apertures formed therethrough and defining a third set of apertures forming a third pattern surrounding said central opening of said gas distribution ring;

said annular cap also having a further plurality of secondary apertures formed therethrough and defining a fourth set of apertures forming a fourth pattern around the interior surface of said ring and located at a level below said third pattern, each of said secondary apertures of said fourth pattern comprising an outlet located proximate the junction between said inner side wall and said inside flange; and a fuel conduit attached to the gas distribution ring and in fluid communication therewith, said fuel conduit having a hollow passage formed therethrough which is in fluid communication with the plenum of the gas distribution ring.

15. The burner apparatus of claim 14, further comprising an adjustable air vent on the fuel conduit.

16. The burner apparatus of claim 14, wherein the base portion of the gas distribution ring has a narrow shelf extending inwardly from each of the respective side walls thereof, for supporting the annular cap thereon.

17. A kit constructing a cooking stove apparatus, comprising:

a wind screen;

a support structure operatively attachable to the wind screen for spacing it upwardly away from a substrate;

a grid for supporting a cooking vessel, said grid being operatively attachable to the wind screen; and a burner apparatus for attachment to said support apparatus, wherein said burner apparatus is the apparatus of claim 14.

* * * * *

UNITED STATES PATENT AND TRADEMARK OFFICE

CERTIFICATE OF CORRECTION

PATENT NO. : 6,742,514 B1
DATED : June 1, 2004
INVENTOR(S) : Robert Eastman II

It is certified that error appears in the above-identified patent and that said Letters Patent is hereby corrected as shown below:

Column 2,
Line 31, change “bum compressed” to -- burn compressed --.
Line 43, change “Bach of the legs” to -- Each of the legs --.

Column 3,
Line 24, insert a space between “FIGS. 2-5,” and “the gas ring”.

Column 4,
Line 4, end paragraph with “the second pattern.”
start paragraph with “Although the present”.

Column 5,
Line 42, change “an outside wall” to -- an outer side wall --.
Line 52, change “distribuiton ring has” to -- distribution ring also has --.

Column 6,
Line 15, change “ring having further” to -- ring having a further --.

Column 7,
Line 11, change “a pattern around” to -- a first pattern around --.
Line 18, change “pattern, each said” to -- pattern, each of said --.

Signed and Sealed this

Fifth Day of April, 2005

JON W. DUDAS
*Director of the United States Patent and Trademark Office*